US007309234B2

(12) United States Patent
Mathog

(10) Patent No.: US 7,309,234 B2
(45) Date of Patent: Dec. 18, 2007

(54) METHOD AND DEVICE FOR INTRODUCING STATE CHANGES INTO ATHLETIC ACTIVITIES

(76) Inventor: David Ross Mathog, 1215 Greenfield Ave., Arcadia, CA (US) 91006

( * ) Notice: Subject to any disclaimer, the term of this patent is extended or adjusted under 35 U.S.C. 154(b) by 85 days.

(21) Appl. No.: 10/025,310

(22) Filed: Dec. 18, 2001

(65) Prior Publication Data

US 2003/0114256 A1 Jun. 19, 2003

(51) Int. Cl.
*A63B 69/00* (2006.01)

(52) U.S. Cl. ..... 434/247; 434/248; 434/251; 434/258

(58) Field of Classification Search ..... 700/91–93; 473/422, 415, 459, 490; 463/1–8, 23, 30, 463/31, 35, 40–4; 273/440, 441, 447, 449, 273/453, 454, 1.5 A, 26 R, 26 C, 108.1, 273/445, 247, 459; 482/3, 8–9, 84, 901, 482/902; 434/118, 247, 248–258, 251; 340/323 R
See application file for complete search history.

(56) References Cited

U.S. PATENT DOCUMENTS 3,629,600 A * 12/1971 Stuler et al. ..... 307/66
3,789,402 A * 1/1974 Heywood et al. ..... 340/384.71
3,933,354 A 1/1976 Goldfarb et al.
4,502,489 A * 3/1985 Alston, Jr. ..... 600/559
4,702,475 A * 10/1987 Elstein et al. ..... 273/445
4,949,320 A * 8/1990 Karrenberg ..... 368/109
5,325,340 A * 6/1994 Ramsey ..... 368/3
5,469,342 A * 11/1995 Chien ..... 362/84
5,812,239 A * 9/1998 Eger ..... 351/203
5,897,457 A * 4/1999 Mackovjak ..... 482/8
5,921,890 A * 7/1999 Miley ..... 482/3
5,921,896 A * 7/1999 Boland ..... 482/83
6,013,007 A * 1/2000 Root et al. ..... 482/8
6,066,105 A * 5/2000 Guillen ..... 600/595
6,278,378 B1 * 8/2001 Feiner et al. ..... 340/815.45
2001/0002928 A1 * 6/2001 Cummins ..... 379/430
2001/0032278 A1 * 10/2001 Brown et al. ..... 710/101

FOREIGN PATENT DOCUMENTS

CA 2169969 A * 2/1998
DE 2409045 A * 9/1975

* cited by examiner

*Primary Examiner*—Corbett B. Coburn
*Assistant Examiner*—Travis Banta

(57) ABSTRACT

A device is described for introducing variation in athletic training and competitive events. This device maintains an internal state that occupies one of several allowed values. Depending upon the selected configuration, the device changes internal state at regular or irregular intervals, progresses through its allowed values sequentially or in random order, and spends a different designated fraction of time in each state. This variable and typically unpredictable state is presented to the field of play where one or more athletes receive the information and react to it as a change in their athletic training or game environment.

13 Claims, 2 Drawing Sheets

The exterior of the invention – side view

FIGURE 1. The exterior of the invention – side view
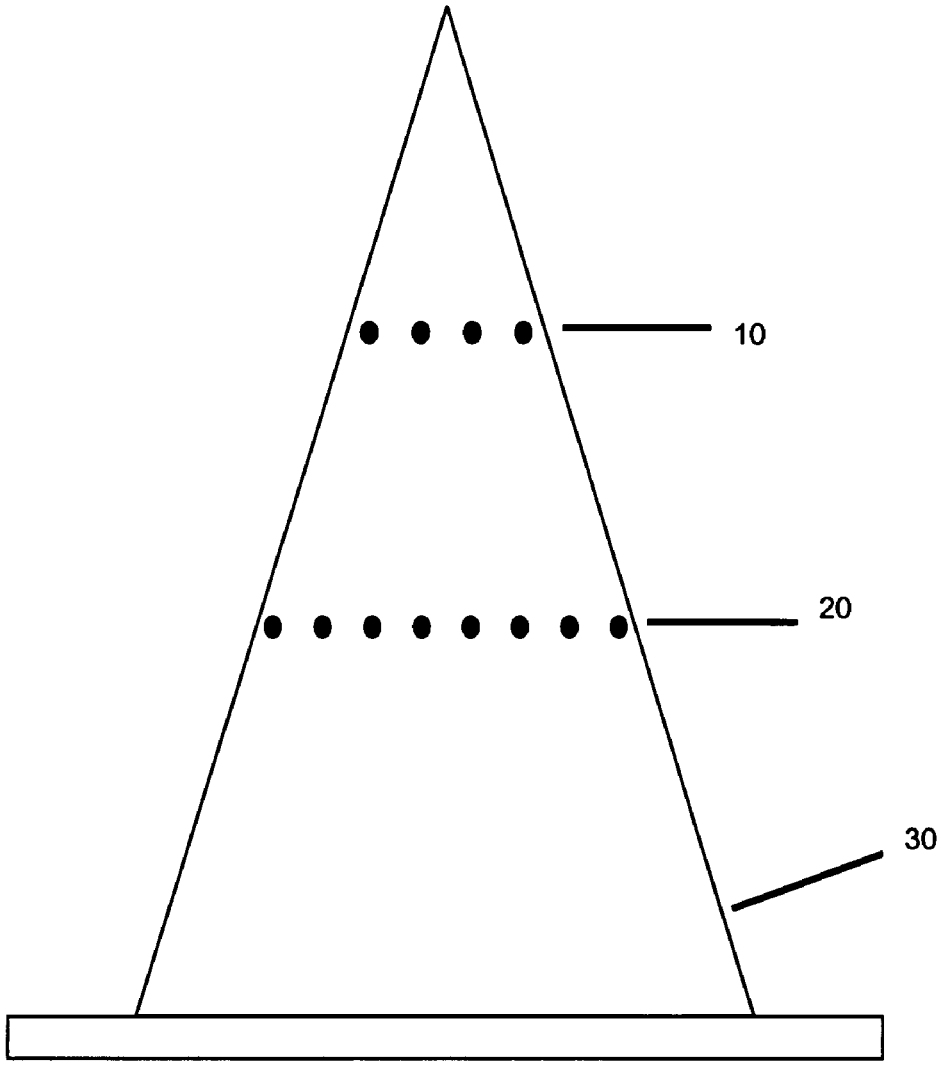

FIGURE 2. Block diagram of the mechanism
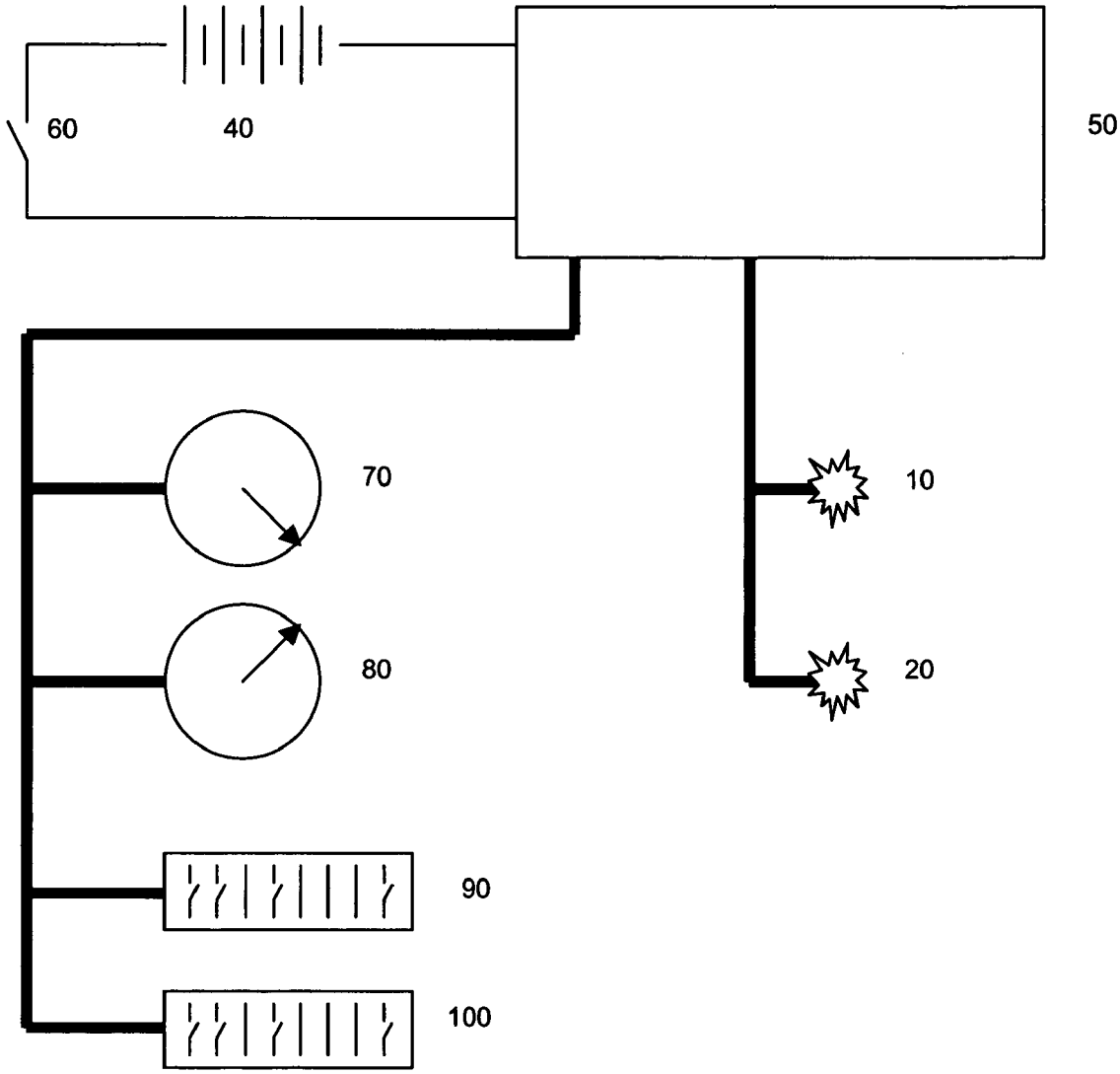

METHOD AND DEVICE FOR INTRODUCING STATE CHANGES INTO ATHLETIC ACTIVITIES

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Most athletic activities require the participants to respond rapidly to changes in their environment. For instance, they must constantly reevaluate their course of action depending upon their own velocity and position and that of a ball, opposing players, and teammates. However in training, and especially in solo training, the environment tends to be largely static. In the game known as soccer in the U.S.A., and football elsewhere, a common training drill consists of a player dribbling a ball around a series of cones or other similar markers. Such variation as exists consists of predetermined decisions such as to alternate between passing on the left on one cone and on the right on the next. Effectively such training exists within an invariant environmental state.

The disadvantage of such a drill is that it does not train athletes to constantly observe, analyze, and react, as they must in a real game. The present invention allows the introduction of transitions between multiple environmental states, such transitions being either strictly periodic or randomly varying in frequency, enabling in training situations a better simulation of the timing and thought processes of the game in question. The invention also allows new types of games to be created and played which incorporate the varying states expressed by the device into the play of the game. The invention accomplishes these goals by maintaining a time varying internal state which is transmitted to athletes, typically via a visual method such as colored lights, so that the athletes may interpret these signals as a change in the training or game environment. In the soccer training drill the invention would replace the traditional practice cone and would indicate to the player the manner in which the ball should be passed around the obstacle.

The intentional introduction of transitions between multiple contest states is common in arcade and video games and other electronic entertainment but there is little precedent for this in athletics. The only common examples occur at or before the actual contest: the opening toss of a coin before a game or the drop of the flag in an automobile race. In music the periodic signal from a metronome is often used and there may be instances where the signal from such a metronome has been used to aid athletes synchronize their movements to music. That differs from the utility of the present invention, which is not synchronization, but the presentation of varying training or game states to the athlete.

The following U.S. patents disclose concepts that bear some relation to the present invention. However, none of the cited prior art discloses an invention having the versatility or utility of the present invention.

Stuler U.S. Pat. No. 3,629,600 discloses a battery powered traffic light controller. This and other traffic controllers differ markedly from the device of the current patent application. Such controllers transition between their 3 states (green,yellow,red) in a single fixed order. Additionally, these transitions are either triggered by external sensors or occur at fixed time intervals. The present invention does not use external sensors to trigger state transitions. Instead, a large repertoire of randomly varying state transitions useful in athletic training are provided. The traffic controllers would be predictable and useless for injecting variation into athletic training. Conversely, the device of the present patent, when configured appropriately for athletic training, would lead to havoc if utilized as a traffic controller.

Ramsey U.S. Pat. No. 5,325,340 discloses an athletic training device which is utilized for pacing. Its function is the antithesis of that of the device of the present patent application. The pacing device produces a certainty. It tells the athlete exactly where to be at a given time and even goes so far as to provide a correction signal when the athlete is too far ahead or behind. The present device produces an uncertainty. Its purpose is to present a signal which is variable and unpredictable. Moreover, the feedback circuit of Ramsey's device requires a measurement of the athlete's position. No such measurement is required or supported by the present invention.

Karrenberg U.S. Pat. No. 4,949,320 and Heywood et al. U.S. Pat. No. 3,789,402 disclose athletic interval training devices. These devices indicate to the athlete a period for each of several athletic activities, typically a repeating run/walk/rest cycle. These devices are essentially modified clocks, they provide the athlete with a fixed and utterly predictable series of changes in the athletic environment. The present device produces an uncertainty—the athlete cannot predict, except statistically, what the environmental state signaled by the device will be at some future time. Both the cited devices and the present device allow the athlete to set the mean time in each state. However, the present device will only asymptotically approach that mean time over a long period and will have a large variance in the duration of each state. Conversely, the cited devices will have no variance (within the accuracy of the implementation) in the duration of each state. This is consistent with the intended uses. The cited devices are long term pacing devices, indicating to the athlete a particular exertion level to maintain for several minutes. The present device instead attempts to mimic the unpredictable and often rapid changes that occur in athletic events.

Miley U.S. Pat. No. 5,921,890 discloses yet another athletic pacing device, this one being optimized for use in swimming. As is true for the pacing devices disclosed above, it is designed to produce a certainty, in this case it emits a periodic signal to which the athlete attempts to synchronize swimming strokes. The utility of the present device is quite different, it is intended to signal unpredictable changes in the athletic environment. The sorts of unpredictable state changes provided by the present device are not appropriate for this type of pacing training. The present device would be better employed aquatically in the training of water polo players, who could be signaled to swim in various directions, for various periods of time, in an unpredictable manner.

Goldfarb et al. U.S. Pat. No. 3,933,354 discloses a martial arts amusement device in which a light at one of ten positions on a picture of a combatant is lit. When a player strikes that position the light turns off, the player's score is incremented, and the game lights another region on the simulated combatant. The lights are selected from a pattern sufficiently complex to appear in random order to the player. This is a one or two player game. This invention is primarily a game rather than a serious athletic training device and it is described in very narrow terms without any general application to other types of athletic training or contests. This invention requires constant input from the player—the game will lock in any device state where a lamp is lit unless the player strikes the lit part of the display to allow it to transition to the next state. The designers recognized that a detector failure would render the game inoperable and provided a failsafe mechanism to transition should that occur—but such a transition is not a normal operating mode of the invention. In comparison, the invention of the present patent application, as it might be implemented for martial arts practice, would have lit one or more lamps for short periods of varying duration during which a lit lamp would have been a target for the athlete. The device would then have transitioned to another device state whether or not the athlete succeeded in striking the target(s). An alternative embodiment, which could be used with existing training dummies, would dispense with the lamps entirely and instead announce the targets through a speaker.

Elstein et al. U.S. Pat. No. 4,702,475 disclose a sports technique and reaction training system in which a particular movement pattern is to be executed by the participant in a given amount of time in response to a start signal that determines which of several such patterns is to be executed. This invention requires that the participant return to a base position to trigger another training cycle—so that the time required to complete the movement pattern may be measured. Moreover, the purpose of the invention is to train the participant to carry out a choreographed set of motions in minimal time. The present invention is very different. Some of the differences are: the position of the athlete with respect to the device is not fixed (there are no intrinsic start and stop positions); the device runs independently of the athlete's actions (other than setting it and turning it on, the athlete would not normally affect the state of the device); more than one device could be simultaneously employed in training or during a game by an athlete or athletes; and the utility of the invention is to provide state transitions in training to better simulate actual play, or in play, to provide more variety to the game, but not to improve the performance of a predetermined choreographed set of motions.

Other instances of the class of athletic measurement devices examined in detail in the preceding paragraph are disclosed in Alston et al. U.S. Pat. No. 4,502,489, Mackovjak U.S. Pat. No. 5,897,457, Guillen U.S. Pat. No. 6,066,105, and Feiner et al. U.S. Pat. No. 6,278,378 B1. These devices all differ from the present invention in requiring two trigger events: one to initiate a measurement and a second one to indicate its termination. The devices then report the performance in some manner. The present invention utilizes no triggers, does not measure performance in any way, and is used in an altogether different manner than any of these devices.

Eger U.S. Pat. No. 5,812,239 discloses a visual training device comprising a plurality of LEDs under microprocessor control arranged around a central hole that in some embodiments holds additional optics. The user looks through the hole and focuses at infinity while simultaneously viewing the LEDs in the peripheral vision as they are lit. To do so the user's eyes must necessarily be centered on the hole and offset back from the device at such a distance that the LEDs will appear in the correct visual region. Effectively this fixes the location of the user's head with respect to the device. This may be an exemplary device for training the eyes of athletes. However, a person standing in a fixed position and rolling her eyes is not engaged in an athletic endeavor, even if such training is of some utility later when she does participate in an athletic activity. These embodiments neither elicit nor allow significant bodily motion and consequently have no utility in athletic training. That this is an eye training device, rather than an athletic training device, is further emphasized by those implementations employing colored filters specifically to exercise different sets of retinal cells, which have different chromatic sensitivities.

Eger also discloses more active embodiments that are designed to measure reaction time and accuracy in response to the visual stimulus. As such, these have triggers and other features as described above for other similar measurement devices, and so differ in fundamental ways from the present invention.

Eger does not disclose in any embodiment or method the concept of changing the state of the athletic environment. Reactions, if any, are always targeted back to the device itself, and specifically to the signaling lamp, such action serving to confirm that the light's stimulus was perceived, and in some cases to measure the speed and accuracy of that response. This differs fundamentally from the present device which informs the athlete of a change in the training or game environment with the athlete's subsequent response being in that context, and being generally external to, and unrelated to, the presence of the device itself. For instance, in a baseball pitching exercise the present device might be located between the pitcher's mound and home plate and would indicate that the ball should be thrown to a particular base or to home plate, all of which are traditional targets in this athletic context. However, the present device would not itself become the target of the directed action. Similarly, replacing an inert cone with a cone shaped embodiment of the present device in a soccer dribbling drill would add variation to an otherwise static practice but it would not change the nature of the cone in that drill by converting it into a target.

BRIEF SUMMARY OF THE INVENTION

This device is to be employed in the training of athletes and the playing of athletic games. During these activities athletes observe and respond to signals that vary with time and are generated and displayed by the device. In this manner the device adds a new element to athletic training and enables new types of sports to be played.

SUMMARY OF THE INVENTION

The present device provides for one or more logical states to be continuously varied, either periodically or randomly, and for this state information to be transmitted to one or more athletes for the purpose of varying the training or game environment. The athlete would perceive this information either visually or aurally as appropriate for each sport. For a specific example consider again the soccer drill described above. This device would either adorn or replace the typical cone marker and would maintain via electronic means two binary variables which would transition On and Off in a periodic or random pattern. This information would be conveyed to the athlete visually—for instance, by providing two rings of light around the cone, one blue, one red, which are lit according to the value of the matching state variable.

Together these two variables would encode four device states with the local (to this cone) meanings "Pass on Left", "Pass on Right", "Pass on Left or Right", and "Do not Pass". The time fraction the device spends in each state would be adjustable, as would be the mean frequency of the transitions between these device states and the minimum hold time spent in each device state before a transition would be permitted. An athlete approaching the cone would observe the state of the device and respond as appropriate. Even this simple four state training device could easily be employed in numerous other drills in this and other sports. For instance, the same four state device placed at the top of the basketball key could indicate "left side layup", "right side layup", "shoot from the top of the key", or "shoot immediately." In baseball it might tell a pitcher to throw a curve, slider, fastball, or to throw out the runner at first base. The invention may also be used to globally alter the rules of the athletic contest or practice. Examples: "when the red light is lit players may not shoot on goal" or "player number 5 may shoot".

BRIEF DESCRIPTION OF THE DRAWINGS

The manifestation of the present invention will necessarily vary depending upon the particular sport. This is particularly true when considering aquatic versus terrestrial playing environments. To illustrate this invention a preferred embodiment is presented for use in the context of a terrestrial game like soccer.

FIG. 1 Side view of the exterior of the preferred embodiment.

FIG. 2 Block diagram of the mechanism of the preferred embodiment.

REFERENCE NUMERALS USED IN THE DRAWINGS

10. Ring of Red Light Emitting Diodes
20. Ring of Blue Light Emitting Diodes
30. Plastic Cone
40. Removable Battery
50. Electronic Controller
60. Power Switch
70. Frequency Dial
80. Hold Time Dial
90. DIP Switch DP1
100. DIP Switch DP2

DETAILED DESCRIPTION OF THE DRAWINGS

FIG. 1 is a drawing of the exterior of the preferred embodiment of the invention. There are two rings of colored light emitting diodes (LED's) on the device, a red one located near the cone's tip 10 and a blue one 20 located near the middle of the cone. The remainder of the exterior of the device is composed of a strong and durable plastic case 30 in a contrasting color such as yellow or light orange.

FIG. 2 shows a block diagram of the mechanism. A removable battery 40 provides power. It is connected to a small electronic controller 50. This is a typical embedded microprocessor based controller that reads its program from internal read only memory. When power is applied via an ON/OFF switch 60, and at one second intervals thereafter, the controller reads the desired device settings from two dials 70, 80, and from a pair of 8 position DIP switches DP1,DP2 90,100, and uses its internal program and this setting information to drive the red 10 and blue 20 sets of display LEDs. The Frequency Dial 70 controls the mean frequency at which the device may change state, which can be varied between 600 transitions per minute and 0.1 transitions per minute. The Hold Time Dial 80 sets the minimum hold time a device state must be maintained before a state transition is allowed and is variable between 200 milliseconds and 5 minutes. The switches on DP1 90 and DP2 100 control the device in the following manner:

DP1,0 determines if the transitions are periodic (fixed rate) or randomly varying around a mean frequency.
DP1,1 determines the device state order as sequential {0, 1,2,3,0 . . . } or random.
DP1,2-4 determine the occupancy for device state 0
DP1,5-7 determine the occupancy for device state 1
DP2,0-1 unused
DP2,2-4 determine the occupancy for device state 2
DP2,5-7 determine the occupancy for device state 3

The occupancy values set on DP1 90 and DP2 100 are integers in the range 0 through 7. The total occupancy for the system is the sum of the four device state occupancies. For instance, if these values were 0,5,3,2 (for states 0 through 3, respectively) the device would never enter state 0, would spend 50% of its time in state 1, 30% in state 2, and 20% in state 3. To vary only between states 1 and 2, and spend equal time (on average) in each the setting would be 0,N,N,0 where N is between 1 and 7. When used in the soccer dribbling drill application a typical setting might be: random transitions with a mean frequency of 15 transitions per minute, a minimum hold time of 0.5 seconds, random transition order, and occupancies set to 2,7,7,2. It is assumed that situations will arise where the invention will also be used as a static marker in fixed state. To lock the device into state 2 the occupancy values would be set at 0,0,7,0.

Table 1 shows the states of the signal lights and their interpretation by the athlete. The first column indicates the state of the red LEDs, the second column the state of the blue LEDs, the third column the device state, and the fourth column indicates the interpretation of the device state to be made by the athlete within the context of a soccer dribbling drill.

| Red Lights | Blue Lights | Device State | Meaning to player |
|---|---|---|---|
| off | off | 0 | Do not pass |
| on | off | 1 | Pass on right side |
| off | on | 2 | Pass on left side |
| on | on | 3 | Pass on either side |

One example of the invention has been described here in detail to comply with the Patent Statutes and to prove that this device could be constructed by one skilled in the arts. It is emphasized that numerous other implementations of the invention are possible, none of which depart from the scope of the invention itself. These include, but are not limited to: utilizing similar or different implementation technologies; utilizing similar or different implementation details, especially presentation of the state to the athlete via alternative means such as symbolic or alphanumeric displays, or synthesized sounds or speech; customizing for one or more different sports; utilizing more or fewer device states; utilizing physically larger or smaller devices; utilizing multiple independent devices simultaneously on the athletic field; utilizing devices which are carried by the athletes or attached to athletic equipment; utilizing remote control of multiple devices which all display the same state; utilizing remote control of multiple devices which display different states; utilizing multiple remote devices which are activated sequentially in a predefined or randomly selected order to simulate, for instance, the motions of another player; and providing in addition to the display of device state information the selective or broadcast relaying of communications from coaches, referees, or other players.

The invention claimed is:

1. A device to assist in the training of athletes and the playing of athletic games, the device comprising:

a case;

a first plurality of signaling elements for emitting a first signal, said first plurality of signaling elements being disposed on an outer surface of the case, wherein each element has an on state in which it emits the first signal, and an off state in which it does not emit the first signal;

a second plurality of signaling elements for emitting a second signal, said second signal being distinguishable from the first signal, said second plurality of signaling elements being disposed on an outer surface of the case, wherein each element has an on state in which it emits the second signal, and an off state in which it does not emit the second signal;

a plurality of device states, wherein combinations of the first signal and the second signal define said device states;

a first dial, said first dial setting a mean frequency of transitions between device states;

a second dial, said second dial setting a minimum hold time spent in each device state before a transition to another device state is permitted;

a plurality of switches, said switches setting a time occupancy for each device state, said occupancy values determining the average time spent in each device state;

a controller for driving said signaling elements, wherein said controller is disposed within the case, and wherein said controller drives the first plurality of signaling elements and the second plurality of signaling elements to produce a continuous series of device states which are always unpredictable in sequence and duration, and wherein the actions of said controller are specified by its internal program, the first dial, the second dial, and the switches;

whereby random variation is continuously introduced into the training of athletes and the playing of athletic games.

2. A device according to claim 1, wherein the case is made of a durable material appropriate for use in an athletic activity.

3. A device according to claim 1, wherein the case is conical.

4. A device according to claim 1, wherein the first and second pluralities of signal emitting elements are disposed in rings around the outer surface of the case.

5. A device according to claim 1, wherein the first signal is a light of a first color, and the second signal is a light of a second color.

6. A device according to claim 1, wherein the first and second pluralities of signaling elements are LEDs.

7. A device according to claim 1, wherein power is supplied by a removable battery.

8. A device according to claim 1, wherein the controller comprises a microprocessor.

9. A device according to claim 1, wherein a switch sets an order of transitions between device states as sequential or random.

10. A device according to claim 1, wherein a switch sets a rate of transitions between device states to be either fixed or randomly varying around a mean frequency.

11. A device according to claim 1, wherein the combinations of the first signal and the second signal define four device states, each of said device states representing a different athletic action.

12. A method for the training of athletes and the playing of athletic games comprising the steps of:

(a) providing a controlling means, wherein said controlling means exists at any given time is in one of a plurality of device states, wherein over time said controlling means transitions between said device states;

(b) providing a setting means, wherein said setting means comprises a plurality of dials and a plurality of switches, wherein said controlling means periodically reads from said setting means those parameters which determine the order and timing of transitions of said controlling means between said device states, wherein said parameters result in said controlling means making a sequence of transitions between said device states which is always random in order and timing;

(c) providing a signaling means, wherein said signaling means is driven by said controlling means, wherein said signaling means may produce a plurality of distinguishable signals corresponding one to one to said plurality of device states, wherein said signaling means produces at each moment in time a signal from said plurality of distinguishable signals which corresponds to that device state in which said controlling means currently exists, wherein said signal is unpredictable by an observer;

whereby allowing athletes to associate said plurality of distinguishable signals one to one with an equal numbered plurality of actions appropriate within the context of athletic training or the playing of athletic games, thus continuously introducing unpredictable variation into athletic training or the playing of athletic games.

13. A method according to claim 12, wherein the controlling means comprises a microprocessor, wherein the setting means comprises:

(a) a first dial, said first dial setting a mean frequency of transitions between device states;

(b) a second dial, said second dial setting a minimum hold time spend in each device state;

(c) a plurality of switches, said switches setting a time occupancy for each device state, wherein the signaling means comprises a set of red LEDs and a set of blue LEDs, wherein said signaling means produces four distinct signals corresponding to all four combinations of said red LEDs and said blue LEDs when on or off.

* * * * *